United States Patent [19]

Morrison, Jr.

[11] Patent Number: 4,650,086

[45] Date of Patent: Mar. 17, 1987

[54] PORTABLE HAZARDOUS WASTE CONTAINER

[76] Inventor: James B. Morrison, Jr., P.O. Box 1105, Friendswood, Tex. 77546

[21] Appl. No.: 683,597

[22] Filed: Dec. 19, 1984

[51] Int. Cl.[4] ..... G21F 9/16

[52] U.S. Cl. ..... 220/66; 206/524.4; 206/524.5; 252/628; 252/633

[58] Field of Search ..... 220/66, 1 C, 1 T, DIG. 6, 220/18, 83; 206/567, 524.4, 524.5, 503; 252/628, 633

[56] References Cited

U.S. PATENT DOCUMENTS

| | | | |
|---|---|---|---|
| 2,603,670 | 7/1952 | Pahler | 206/524.5 X |
| 3,466,445 | 9/1969 | Schlies | 250/108 |
| 3,534,796 | 10/1970 | Knaus | 150/0.5 |
| 4,082,390 | 4/1978 | Gibson et al. | 206/503 X |
| 4,107,044 | 8/1978 | Levendusky | 252/628 X |
| 4,108,609 | 8/1978 | Petzinger | 220/1 T X |
| 4,156,147 | 5/1979 | Naum | 250/518 |
| 4,166,536 | 9/1979 | Roberts | 206/524.3 |
| 4,213,883 | 7/1980 | Owens | 252/478 |
| 4,218,622 | 8/1980 | McMurtry | 250/518 |
| 4,222,889 | 9/1980 | Uerpmann | 252/301.1 R |
| 4,362,434 | 12/1982 | Valiga | 405/128 |
| 4,422,964 | 12/1983 | Capolupo | 252/628 |
| 4,464,081 | 8/1984 | Hillier | 408/128 |

OTHER PUBLICATIONS

International Chempack Corporation Brochure.
International Chempack Corporation re: Enviropack.

*Primary Examiner*—Steven M. Pollard
*Attorney, Agent, or Firm*—Arnold, White & Durkee

[57] ABSTRACT

Portable hazardous waste containers can be used both for storage and transportation. Waste from an unsatisfactory container, an open pit, or a process stream can be placed in the container, which can then be shipped, if necessary, to a disposal site and then buried in a landfill. By using proper materials and container dimensions, a single container can satisfy the separate regulatory requirements for waste storage and transportation.

4 Claims, 4 Drawing Figures

Fig. 1
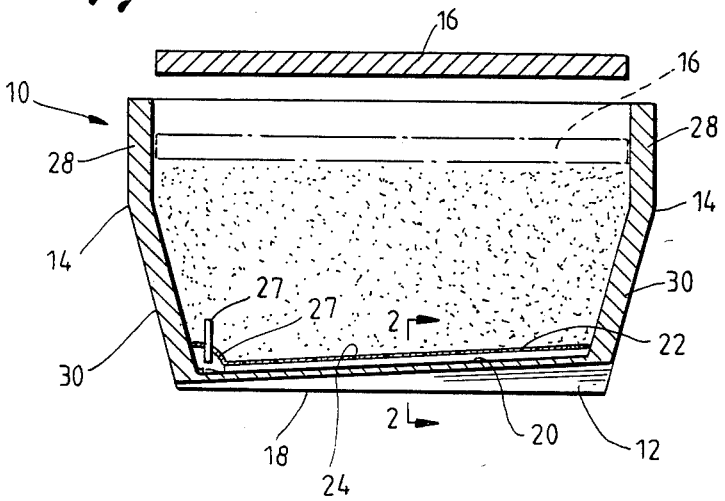
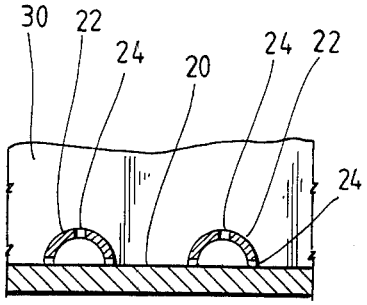
Fig. 2
Fig. 3
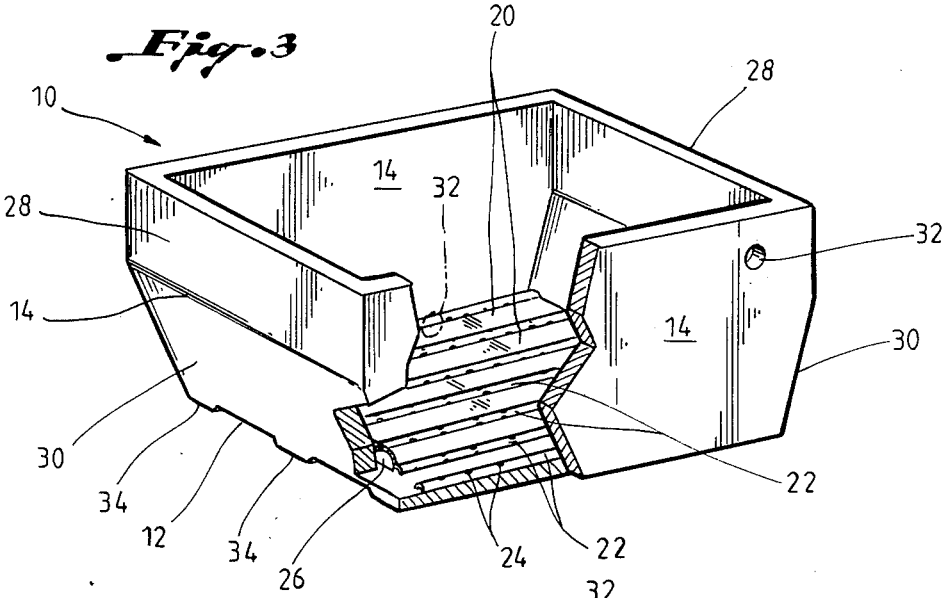
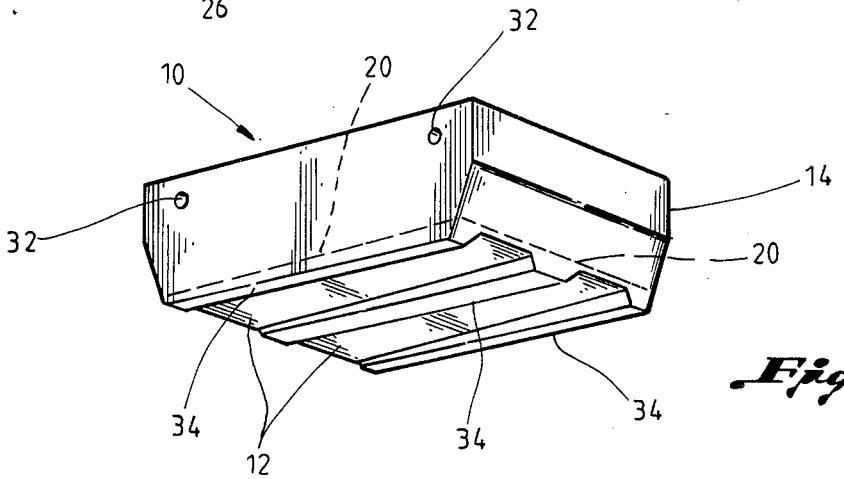
Fig. 4

PORTABLE HAZARDOUS WASTE CONTAINER

BACKGROUND OF THE INVENTION

The present invention concerns the handling and disposal of hazardous wastes and, more specifically, containers in which such wastes can be transported and stored.

Hazardous wastes are substances which are usually unwanted byproducts of industrial processes, and are a present or potential danger to the health of humans or other living organisms because they exhibit undesirable properties such as toxicity, carcinogenicity, nondegradability, biological magnification, or the like. Under present technology, a wide variety of useful products cannot be manufactured without also producing some hazardous wastes. It is not presently possible to recycle all of the wastes, so safe means of disposal must be found.

As awareness of the dangers of air and water pollution has increased, methods of disposing of wastes into the air (through burning, for example) and in rivers or oceans have been recognized as being undesirable in many situations. Legislation and regulations strictly limit such disposal methods in the United States and in many other countries.

As disposal of hazardous wastes into the air and water has been reduced, there naturally has been an increase in the amounts disposed of on land. One land-based method is to dig a pit in the ground and merely dump the wastes into it. Another method is to bury the wastes in a landfill.

In many land-based disposal methods, preventing the wastes from contaminating the ground water supply is a major concern. In landfills, this problem is often addressed by excavating the landfill pit in soil that is naturally rich in clay, a substance which is relatively impermeable to water, and then adding an additional layer of compacted clay on top of the excavated surface. A layer of gravel is often placed on top of the compacted clay. Government regulations sometimes require an additional artificial lining layer on top of the compacted clay and gravel. Wastes to be buried in the landfill are usually solidified, if they are originally liquid, by adding a bulking agent such as kiln dust, fly ash, or lime (all of which have hydrating characteristics). The solidified waste is then dumped in the bottom of the landfill, and covered with a material that will help seal the waste from the elements, thus forming a waste "cell". This process is repeated each day so the landfill gradually fills up with cells of covered waste, each covered with an individual clay cap when full. When the landfill is completely full, a final cover, which might be a two foot thick layer of clay, is placed over the top. Grass might be planted on top to help control erosion.

The success of the clay and artificial liners in preventing leaching of the wastes from the landfill into the surrounding ground water must be monitored. One way of doing so is to build a sump at the bottom of the gravel layer. A pipe or tube can be used to connect this sump to the surface, so the nature of the liquid in the sump can be tested periodically. Another way is to drill water sampling wells at several points around the landfill. If hazardous substances can be detected in the water taken from these wells, the wastes may be leaking from the landfill.

Some landfills or pits are located adjacent to or within the confines of plants that generate hazardous wastes. However, many disposal areas are at remote locations, so the waste must be transported from the point of generation to the point of disposal. The dangers of exposure to the waste require that strict precautions be taken when it is shipped. For example, the container in which it is shipped must be strong enough to prevent leakage. If the waste containers are to be shipped on the highways, they should be able to withstand the stress exerted by a collision between the truck which is carrying them and another vehicle.

As public awareness of hazardous waste has increased, efforts have begun to clean up unsatisfactory dump sites. The "Superfund" legislation in the United States is one example of such a program. Hundreds of hazardous waste sites have already been identified in the United States in which waste is not now safely stored. Many of these sites will be cleaned up by transferring the waste to new disposal sites which meet current regulations. Thus, the Superfund and other similar cleanup programs involve two potentially troublesome aspects of hazardous waste handling: transportation and disposal. Of course, industrial sources continue to generate hazardous waste daily, and much of it must also be transported to disposal sites.

At the same time, increased public and scientific concern about hazardous waste has drastically slowed the opening of new landfills. Proposing the opening of a new site raises difficult political as well as technological questions, which are often addressed in regulatory proceedings that can last for years. Therefore, at a time when the demand for environmentally sound disposal facilities is large, the supply of such facilities has been sharply limited. Any procedure that would permit the reuse of existing sites would be a tremendous benefit. The present invention is an improvement in hazardous waste technology which can help solve some of the problems of both transportation and disposal, and can give the public greater confidence in the safety of those operations.

SUMMARY OF THE INVENTION

A portable hazardous waste container in accordance with the present invention includes a plurality of members that define an enclosed volume, the members being substantially impermeable to water, corrosion resistant, and having structural strength sufficient to withstand being filled with waste, lifted, transported, and stacked in a landfill. "Members" is meant to include walls, tops, bottoms, and the like. Such a container can be used both to store and to transport waste. For example, in the cleanup of an existing dump where the waste is in rusted barrels, the waste can be transferred from the barrels to containers in accordance with the present invention. And if the waste has contaminated the soil, thereby potentially threatening or actually polluting the ground water, the contaminated soil can be excavated and placed within the containers. If the site is otherwise acceptable, the waste can safely be stored there in the containers until adequate disposal facilities can be permitted and constructed or new technology is developed that will allow reclamation or destruction of the hazardous materials.

If the site is not acceptable, due to lack of proper clay strata or for other reasons, the waste can be transported by truck in the same containers to an acceptable site. There, the containers can simply be stacked in or on the disposal site. The strength, impermeability, and corrosion resistance of the containers enable them to satisfy regulatory requirements for both transportation and disposal. The container itself can also satisfy the requirements for an artificial liner in a landfill. Containers in accordance with the present invention should be useful in aboveground storage facilities as well as in below ground landfills.

One specific embodiment of the present invention is a portable hazardous waste container which includes a rectangular base, four walls, and a lid. The base has a horizontal lower surface and an upper surface which is sloped downward from one of its ends to the other. The four walls are integrally connected to each other and to the base. Each wall includes an upper segment and a lower segment, with the upper segments being perpendicular to the base. The lower segments slope outwardly from the base to the point where they join the upper segments. The lid fits into the opening defined by the four upper segments to form a sealable container. This embodiment of the present invention also includes a plurality of hollow linear tubes which are located on the upper surface of the base. The tubes extend from the end of the base which has the highest elevation to the end of the base which has the lowest elevation, and each tube has a plurality of holes in its surface. These tubes feed, at their lower end, into a sump, and means for detecting water in the sump are also included in the container.

The present invention has significant advantages over previously used hazardous waste technology in terms of simplicity, suitability for multiple uses, and ability to increase public confidence in hazardous waste handling.

BRIEF DESCRIPTION OF THE DRAWINGS

FIG. 1 is a cross-sectional view of a portable hazardous waste container in accordance with the present invention viewed from the side.

FIG. 2 is a cross-sectional view of the tubes designated by reference numeral 22 in FIGS. 1 and 3.

FIG. 3 is a perspective cut-away view of a container in accordance with the present invention.

FIG. 4 is a perspective view from below of a container in accordance with the present invention.

DETAILED DESCRIPTION OF SPECIFIED EMBODIMENTS

Portable hazardous waste containers in accordance with the present invention can take many forms. One suitable form has a rectangular top and bottom and four walls connecting them. The dimensions of such a container would depend upon the density of the waste and on the applicable weight and width regulations for transportation. For example, if the waste is to be transported by truck and is contaminated soil which has a density of 2,500 pounds per cubic yard, U.S. highway weight and width regulations may make it appropriate for the container to have a volume of about 15 to 20 cubic yards. A container 13 feet long, 8 feet wide, and 4 feet tall would fall within this range.

FIG. 1 shows a portable hazardous waste container in accordance with the present invention in cross-section from the side. The container 10 has a base 12, walls 14, and a lid 16. The base 12 and walls 14 form an integral unit. The size of the lid 16 permits it to slide into the opening defined by the walls 14, forming a sealed unit. As FIG. 1 shows, the base 12 is preferably not of uniform thickness, but instead has a horizontal bottom surface 18 and an upper surface 20 which has a greater elevation at one end than at the other. The purpose of this sloping of the upper surface 20 of the base 12 is to cause any liquids which enter the container 10 to flow by gravity toward the lowest end. Causing liquids to collect in this way will aid in detecting them, and thus will aid in detecting leaks in the container.

One useful way of preventing leakage of the waste out of the container into the surrounding ground water supply is to monitor leakage of water into the container. This can be done because the waste in the container is always solidified before burying, according to government regulations, so no water should be present inside the container. Thus, if leakage of the waste out of the container is to occur, first some liquid must get into the container to act as a carrier for the leakage. Therefore, monitoring the lowest point of the container for the presence of water is a valuable way of preventing pollution of surrounding ground water supplies if the container should develop a leak.

To help collect any water present inside the container, it can have located on the upper surface 20 of its base 12 a series of hollow tubes 22. The tubes 22 preferably extend linearly from the end of the base 12 with the highest elevation to the end with the lowest elevation. FIG. 3 shows that there can be a plurality of these tubes 22 parallel to each other. The tubes have a plurality of holes 24 in them. Thus, liquid in the container will run to the bottom, pass through the holes 24, and flow downhill in the tubes 22. The holes 24 should be sized so that solid particles of earth and the like will not fit through them. As FIG. 2 shows, the tubes 22 can suitably have a semi-circular cross-section.

The tubes 22 feed into a sump 26, shown in both FIG. 1 and FIG. 3. It is the sump 26 which is monitored for the presence of water, and this monitoring can be done in several ways. One way which is especially advantageous if a large number of the containers are to be stacked in a landfill is to have an electronic water sensing probe 27 in the sump 26. The probe for each container in a landfill can be electronically connected to a panel of warning lights in a central control room. If one or more containers develop a leak and water intrudes, the water will collect in the sumps of those containers and their specific warning lights will flash. This system permits the operator to know the specific containers that are leaking, and to focus repair efforts on them. This can clearly be a major advantage if hundreds or thousands of containers are stacked side by side and on top of each other in a landfill. Without such specific knowledge of the source of the potential leak, the operator might have to lift out every container to find which ones are causing the problem. As a backup system, the probe can be withdrawn from any container and a tube can be inserted into the sump, and then any liquid present can be withdrawn through the tube to the surface. This leak detection arrangement has substantial advantages over that which has been previously used.

Returning to FIG. 1, the container shown there has walls 14 which each have an upper segment 28 and a lower segment 30. The upper segments 28 are perpendicular to the bottom surface 18 of the base 12. Therefore, if the base 12 is rectangular, there will be four walls 14. There will also be four upper segments 28, which will define a rectangular top opening. The four lower segments 30 each slope outwardly from the point where they join the base 12 to the point where they join the upper segments 28. Thus, if one took a horizontal cross-section of the container 10, it would be rectangular whether taken at the level of the upper segments 28 or that of the lower segments 30. In this embodiment, the area of the horizontal cross-section will be greater at the level of the upper segments 28 than at the lower segments 30.

The purpose of having upper and lower segments 28 and 30 in the walls 14 is to adapt the container to different volumes of waste. If the container 10 is filled full with waste, the lid 16 can be slid into the opening defined by the upper segments 28 until it is flush with the top of those segments. Alternatively, if the waste is relatively dense and the container 10 cannot be filled all the way to the top because of highway weight limits or the like, the lid 16 can be slid down until it comes into contact with the waste, as shown by the dotted lines in FIG. 1. Thus, no matter how full the container is filled, the lid 16 will be resting on the waste, which will give the lid added support.

After the lid 16 is inserted, the container 10 can be sealed in a number of ways, depending upon the material from which it is made and other factors. If the container 10 is constructed of a resinous polymer such as polyethylene, it can be sealed by heating so that the lid 16 will melt into the upper segments 28. Other resinous polymers that might be useful are polybutylene and polybutadiene. Different container materials might be required depending on the properties of the waste to be enclosed.

The advantage of having sloping lower segments 30 in the walls 14 is in transporting the containers when empty. Several lids can be placed one on top of another on the bed of a truck, and the other halves (base 18 plus walls 14 all formed into an integral unit) of the containers 10 can be stacked on top, with each container nesting inside the one below it.

The full containers can be picked up by a crane. To aid in this, it is desirable to have molded onto the walls 14 of the container grapsing means, such as the circular indentations 32 shown in FIGS 3 and 4. These indentations would aid the tongs, teeth, or hooks used by a crane to firmly grasp the container.

Since the upper surface 20 of the base 12 is sloped, the overall thickness of the base will be greater at one end than the other. One way to minimize the weight increase caused by this thickness differential is shown in FIG. 4. Instead of having a solid base, a plurality of tapering ribs 34 are located on the bottom of the base 12. The bottom surfaces of these ribs 34 are horizontal. At the end at which the elevation of the base's upper surface 20 (represented by a dotted line in FIG. 3) is highest, the ribs will have a given height. The ribs 34 decrease in height towards the opposite end, tapering down to zero height at the opposite end. Thus, the space inbetween the ribs 34 will be open and accordingly will not unnecessarily contribute to the overall weight of the container 10.

The ribs could also be spaced so as to enable the container to be carried conveniently on a roll-off truck. Such a truck has longitudinal rails on its bed, and a hydraulic system with an attached cable to pull a container onto the bed. The container usually has some type of rails on its bottom which fit against the rails on the bed, thereby preventing the container from moving from side to side. Properly spaced ribs on the bottom of a container in accordance with the present invention will fit against the rails on a roll-off truck, thereby allowing the container to be transported on such a truck.

Containers in accordance with the present invention can be used in hazardous waste handling as follows. Waste, whether in a leaking container, a pit, or in a process stream being produced by a plant, is placed into the container. The lid is put in place and sealed. The sealed container can then be loaded onto a truck and transported to the site where it will be stored. (Alternatively, if the waste is merely being transferred from an unsatisfactory container, the new container can be placed exactly where the old one was.) The container is then unloaded and placed in the disposal site, whether above or below ground. The containers can be placed side by side and stacked on top of each other to make the most efficient use of space. If the containers include water sensing means, the means for each container can be connected to a separate warning light in a control center, to aid in the location of leaks, if they occur.

The preceding is a description of one embodiment of the present invention. Those skilled in the art will recognize that a variety of modifications could be made to this embodiment that would remain within the scope and spirit of the present invention. For example, instead of having walls with two segments as described above, the walls of the container could be single segments which are either all perpendicular to the base, or all outwardly sloping. Likewise, the number of walls could be other than four. Other possible modifications will be apparent to those skilled in the art.

I claim:

1. A portable hazardous waste container, including a rectangular base whose upper surface is sloped downward from one of its ends to the opposite end;

four walls which are integrally connected to each other and to the base, each wall including an upper segment and a lower segment, the upper segments being perpendicular to the base and defining a rectangular upper opening, and the lower segments sloping outwardly as they estend upwardly from the base;

a rectangular lid which fits into the upper opening so as to form a sealable container;

a sump located at the end of the base which has the lowest elevation;

a plurality of hollow linear tubes located on the upper surface of the base, the tubes extending from the end of the base which has the highest elevation to the end of the base which has the lowest elevation, each tube having a plurality of holes in its surface, with each tube feeding into the sump; and means for detecting water in the sump, said container being sized to conform to applicable Federal Transportation Regulations.

2. The portable hazardous waste container of claim 1, including grasping means on the exterior of the container to aid in lifting it.

3. The portable hazardous waste container of claim 1, where the base, sides, and lid are constructed of a resinous polymer.

4. The portable hazardous waste container of claim 1, where the resinous polymer is polyethylene.

* * * * *

UNITED STATES PATENT AND TRADEMARK OFFICE

CERTIFICATE OF CORRECTION

PATENT NO. : 4,650,086

DATED : March 17, 1987

INVENTOR(S) : JAMES B. MORRISON, JR.

It is certified that error appears in the above-identified patent and that said Letters Patent are hereby corrected as shown below:

Column 3, line 43, change "SPECIFIED" to --SPECIFIC--.

Column 6, line 40, (line 9 of claim 1), change "estend" to --extend--.

Signed and Sealed this

Eighth Day of September, 1987

*Attest:*

DONALD J. QUIGG

*Attesting Officer*

*Commissioner of Patents and Trademarks*